United States Patent [19]

Hartemann

[11] 4,193,473

[45] Mar. 18, 1980

[54] REFRACTIVE STIGMATIC SYSTEM FOR ELASTIC SURFACE WAVES

[75] Inventor: Pierre Hartemann, Paris, France

[73] Assignee: Thomson-CSF, Paris, France

[21] Appl. No.: 813,650

[22] Filed: Jul. 7, 1977

Related U.S. Application Data

[63] Continuation of Ser. No. 520,203, Nov. 1, 1974, abandoned.

[30] Foreign Application Priority Data

Nov. 2, 1973 [FR] France ..... 73 39082

[51] Int. Cl.[2] ..... G10K 11/00

[52] U.S. Cl. ..... 181/176; 333/150; 367/150

[58] Field of Search ..... 181/176, 0.5 R; 340/8 L; 333/30 R, 71, 72; 350/175 R, 211

[56] References Cited

U.S. PATENT DOCUMENTS

| | | | |
|---|---|---|---|
| 2,684,724 | 7/1954 | Hock | 181/176 |
| 3,654,574 | 4/1972 | Dias | 333/71 |
| 3,797,915 | 3/1974 | Lard et al. | 350/211 |
| 3,818,379 | 6/1974 | Wauk | 333/30 R |
| 3,826,562 | 7/1974 | Baumgardner et al. | 350/211 |
| 3,866,711 | 2/1975 | Folds | 181/176 |
| 3,903,990 | 9/1975 | Tannaka | 181/176 |

FOREIGN PATENT DOCUMENTS

| | | | |
|---|---|---|---|
| 2045763 | 5/1971 | France | 181/176 |
| 2070546 | 10/1971 | France | 181/176 |

OTHER PUBLICATIONS

"Sound Focussing Lenses and Wave Guides," by T. Tarnoczny, Ultra Sonics, Jul.-Sep. 1965, pp. 115-127.

*Primary Examiner*—Stephen J. Tomsky

*Attorney, Agent, or Firm*—Cushman, Darby & Cushman

[57] ABSTRACT

The present invention relates to refractive stigmatic systems designed to deflect or focus elastic surface waves which can propagate at the surface of a substrate. The object of the invention is a lens or prism comprising an array of elementary refractive zones formed by deposition or ion implantation and intended to produce uniform attenuation of refracted vibrational radiation.

9 Claims, 6 Drawing Figures

REFRACTIVE STIGMATIC SYSTEM FOR ELASTIC SURFACE WAVES

This is a continuation of application Ser. No. 520,203, filed Nov. 1, 1974, now abandoned.

The present invention relates to stigmatic systems designed to deflect or produce convergence in a beam of surface elastic waves. The function of the stigmatic systems with which the present invention is concerned, is similar to that performed by the lenses and prisms utilised in optical work. It is achieved by the formation at the surface of a substrate, of a refractive zone within which the surface waves can propagate at a different velocity from that at which they propagate in neighbouring regions. The modification of the velocity of propagation can be achieved by depositing at the surface of the substrate, an elastic layer of appropriate kind whose effect is to reduce said velocity in the covered zone. In the case of crystalline substrates, the change in propagation velocity can likewise be achieved by an ion implantation operation which modifies the substrate structure and its physical properties in an implanted zone underlying its surface. In contrast to the refractive media encountered in optical systems, which have good transparency to light waves, the refractive zones provided for the directive transmission of elastic surface waves, have a degree of attenuation which is not negligible. The result is that acoustic lenses and prisms are not only refractive stigmatic systems but also systems introducing non-uniform attenuation and this constitutes a drawback. To overcome this drawback, the invention proposes refractive stigmatic systems for elastic surface waves, in which the beams of vibrational energy have to pass through adjacent elementary zones whose thickness is small or varies very little over the whole extent of the beam being refracted.

In accordance with the present invention there is provided a refractive stigmatic system for the directive transmission of elastic surface waves, said system comprising: a substrate having a surface for propagating said elastic surface waves, and at least one refractive zone; the velocity of propagation of said elastic surface waves in the extent of said refractive zone differing from that encountered in the neighbouring regions of said surface; said refractive zone being formed of an array of elementary zones simultaneously receiving said elastic surface waves; the respective lengths of the paths of travel followed by said elastic surface waves within said elementary zones having substantially equal average values.

For a better understanding of the present invention and to show how the same may be carried into effect, reference will be made to the ensuing description and the attached figures among which:

FIG. 6 is a planned view of an acoustic prism in accordance with the invention.

Figure 1:
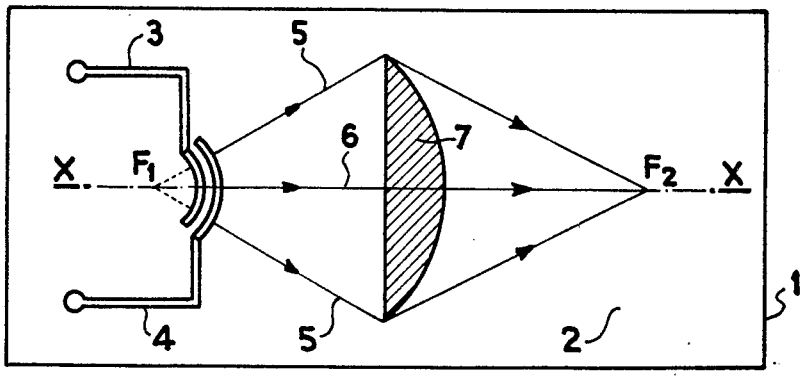
FIG. 1 PRIOR ART
FIG. 1 is a plan view of a known kind of acoustic lens.

In FIG. 1, there can be seen the top face 2 of a substrate 1 upon which there have been deposited two conductive electrodes 3 and 4 in order to form, conjointly with the substrate, an electromechanical comb transducer capable of radiating elastic surface waves. Because of the curved form of the space separating the electrodes 3 and 4, when electrically excited the transducer produces a vibrational radiation the central rays 6 and marginal rays 5 of which meet at a point $F_1$ on the axis XX. A refractive zone which has been shown in cross-hatched fashion, has been formed at the surface 2 of the substrate in order to cause the vibrational radiation which it receives via the rectilinear portion of its contour, to converge at $F_2$. The said zone 7 can be produced in a manner known per se by depositing an elastic layer at the surface 2 of the substrate 1.

By way of non-limiting example, using a crystalline substrate of lithium niobate upon which a gold film some few microns in thickness has been deposited, there will be observed in the zone covered by the film a relative reduction in the phase velocity, which reaches as much as 10% for an elastic surface wave frequency of 25 Mhz.

Using the same crystalline substrate this time with a technique of ion implantation, there will be observed in the implantation zone a relative reduction of lesser magnitude at frequencies higher than 100 MHz. Whether the technique of deposition or that of implantation of ions is used, within the cross-hatched zone a propagation medium is obtained whose refractive properties differ from those of the neighbouring regions of the substrate.

Because of its convex profile, the refractive zone 7 behaves like a convergent acoustic lens. It causes the vibrational radiation emitted by the transducer to converge at the point $F_2$ located upon axis XX which is its optical axis. It will be observed that with a lens of this kind, the thickness traversed is much greater in the case of the central ray 6 than it is in the case of the marginal rays 5. Since the zone 7 is not only refractive but also absorptive vis-a-vis the emitted vibrational radiation, it will be appreciated that the vibrational energy distribution in the section of the beam is rendered non-uniform. The non-uniform attenuation of the vibrational energy as a consequence of its transit of the zone 7, constitutes the drawback which the present invention seeks to overcome.

The invention proposes that the refractive zone should be formed as an array of elementary zones capable of refracting the elastic surface waves whilst attenuating them in a relatively uniform fashion and to the least possible extent.

Figure 2:
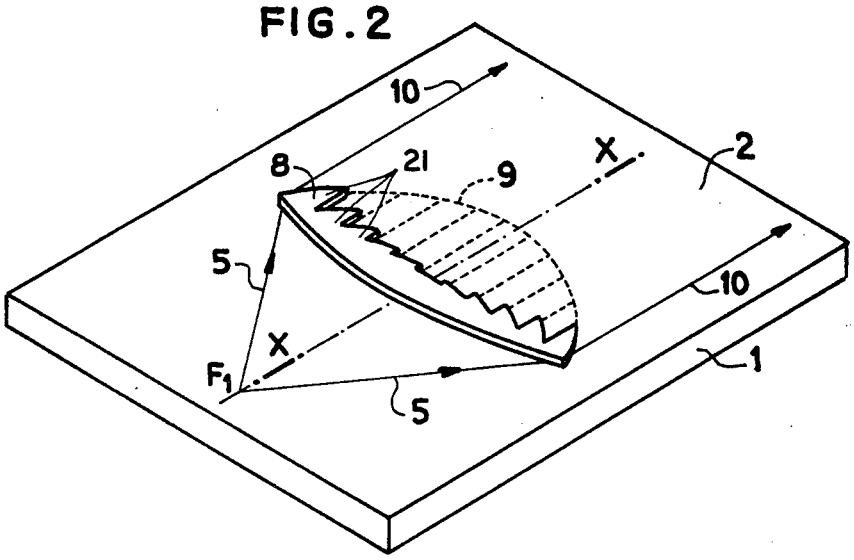
FIG. 2 is an isometric view of an acoustic lens in accordance with the invention.

In FIG. 2, at the surface 2 of a substrate there can be seen an acoustic lens in accordance with the invention. It is produced by the deposition of an elastic layer 8 whose profile in the surface 2 is delimited by a saw-tooth line and by a closing line which receives the vibrational radiation 5 issuing from the point $F_1$. This acoustic lens is of the convergent type and can, as FIG. 2 shows, transform the incident radiation 5 into a parallel radiation 10. If it were formed by the technique illustrated in FIG. 1, the downstream portion of its profile would have to be constituted by the line 9 shown in dotted fashion. In fact, in order to equalise the attenuation in the different regions through which the energy passes, the profile portion 9 has been substituted by a saw-tooth line having equivalent refractive properties. In FIG. 2, the geometry of a Fresnel lens can be seen, which in the example illustrated comprises an array of eleven elementary zones 21. The separation between the elementary zones 21 is represented by the dotted lines parallel to the direction of emergence of the vibrational radiation 10.

Figure 3:
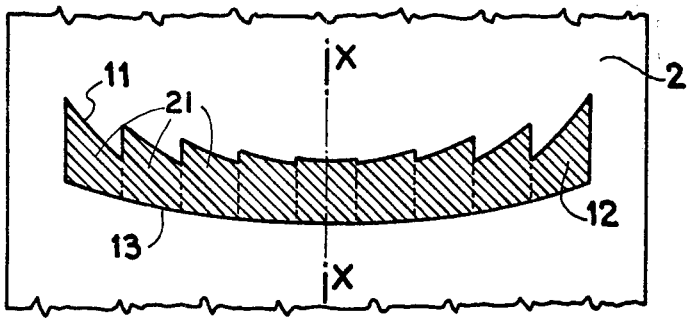
FIG. 3 is a planned view of another acoustic lens in accordance with the invention.

FIG. 3 illustrates the profile of an acoustic lens which is divergent if the cross-hatched zone 12 transmits the elastic surface waves at a lower velocity than that encountered in the neighbouring regions of the surface 2 of the substrate. By contrast, if the propagation velocity is increased within the zone 12, this constitutes a convergent lens. This case occurs if the zone 12 is an implanted zone in a crystalline quartz substrate. The Fresnel like lenses of FIGS. 2 and 3 have a portion of saw-tooth profile 11 delimiting a first diopter. The other diopter is constituted by a portion of curved profile 13 which delimits in relation to the saw-tooth profile 11, an array of elementary zones 21 which produce attenuation of the surface waves passing through them. The experienced attenuation exhibits small departures from a constant value which corresponds to the mean path of travel located midway between the limits of each one of the elementary zones 21. Since the peak to peak variation of the length of the path of travel is maintained small, and since the mean paths are kept constant from one elementary zone to the next, the resulting attenuation is substantially uniform along the entire array.

Without departing from the scope of the invention, the portion 13 of the profile of the zone 12 could equally well have a saw-tooth form. It should also be noted that the case of the refractive acoustic prism falls within the scope of the invention. It is well known, in other words, that a piece of a lens can be likened to a prism and in that sense it is sufficient to consider a fraction of the zone 12 to the left or to the right of the axis XX, in order to obtain the prism configuration. In this latter case, the flanks 130 of the saw-tooth formation are rectilinear and parallel as shown in FIG. 6.

Figure 4:
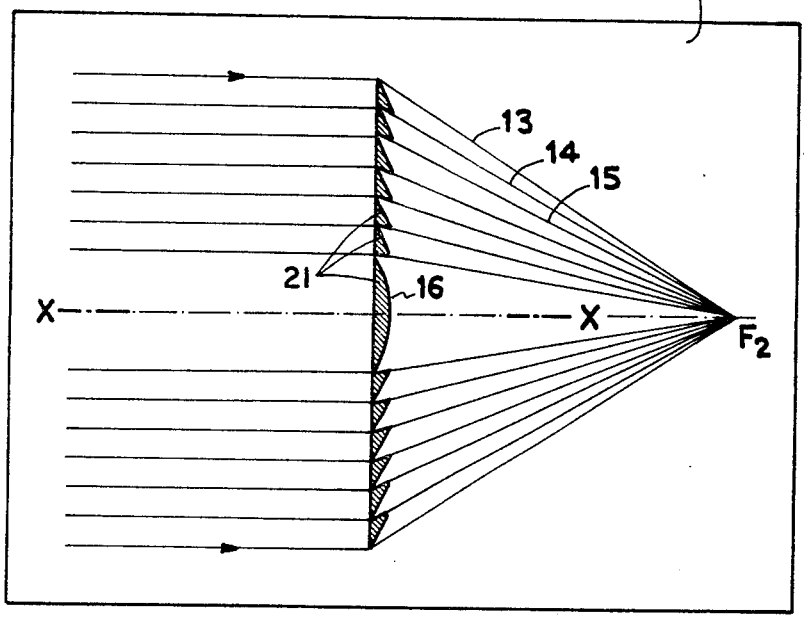
FIG. 4 is a planned view of a variant embodiment of an acoustic lens in accordance with the invention.

FIG. 4 illustrates a Fresnel like acoustic lens 16 whose thickness has been reduced as far as possible in order to reduce the attenuation of the elastic surface waves.

As FIG. 4 shows, this lens has a profile delimited by an a rectilinear upstream line and by a downstream line of saw-tooth shape whose tips touch the upstream line. Thus, an array of elementary refractive zones 21 is created, these zones 21 touching one another virtually at a point in each case. In FIG. 4, a parallel beam of elastic surface waves has been shown the elementary beams of which illuminate the triangular zones 21 and the central lenticular zone 21 of the lens 16. The beam which emerges between the rays 13 and 14 is refracted towards the focus $F_2$ as also is the beam defined between the rays 14 and 15 and all the others. The rays 13, 14, 15 which mark the separation between the elementary refractive zones 21, have lengths which differ from one another by a multiple of the wave length $\lambda$ of the elastic surface waves. As an alternative, the upstream line may have a curved shape.

The divergent version of the acoustic lens can readily be created by applying to FIG. 3 the thickness reduction illustrated in FIG. 4.

The refractive stigmatic systems of FIGS. 2 to 4, are all constituted by the stringing together of elementary refractive zones 21 amongst which there may be a central lenticular zone 21 surrounded by zones of triangular or trapezoidal shape.

Each elementary triangle or trapezium has a concave or convex side and an adjacent side orientated preferentially in the direction of incidence or emergence of the refracted vibrational radiation. The lenses have the advantage of possessing a single centre of convergence. Thus, without departing from the scope of the invention, it is possible to create acoustic lenses the elementary zones 21 of which form a zonal array. It is well known that a variable-pitched array of this kind is capable of causing incident radiation to converge at at least one focus.

Figure 5:
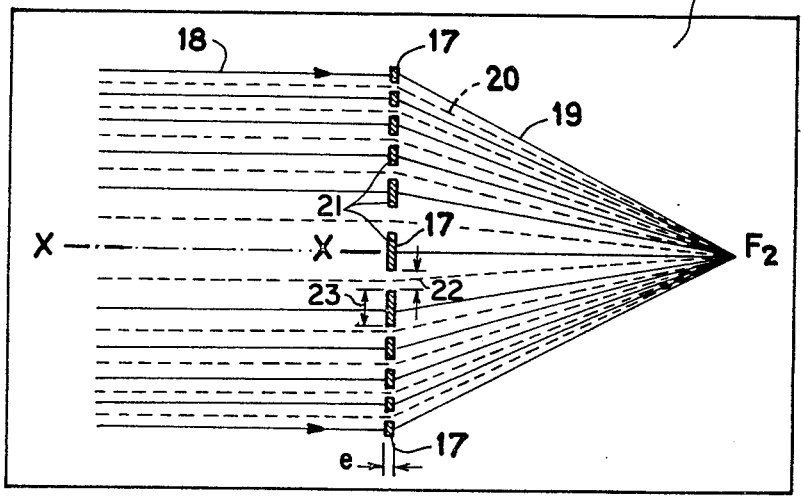
FIG. 5 is a planned view of another variant embodiment of an acoustic lens in accordance with the invention.

A zonal acoustic lens has been shown in FIG. 5. It comprises a refractive zone constituted by an array 17, of spaced elementary refractive zones 21. The variation in the spacing 22 of the elementary zones 21 and their width 23, are chosen in order to correspond with two interlaced sets of Fresnel-like zones which direct towards the focus $F_2$ equiphasal waves, in the directions of the full-line rays 19. Other equiphasal waves go to the focus $F_2$ in the direction indicated by the dotted rays 20. By an appropriate choice of the thickness of the refractive zones 21, it can be arranged that the two groups of equiphasal waves add their effects when the incident radiation 18 is received by the elementary zones 21 and by the intervals 22 separating them. This result peaks when the radiation passing through an interzone gap 22 gains or loses a multiple of the half wave length in respect of the radiation passing through one of the surrounding zones 21.

What I claim is:

1. A refractive stigmatic system for the directive transmission of elastic surface waves, said system comprising: a substrate having a surface for propagating said elastic surface waves, and at least one refractive zone located in said surface; the velocity of propagation of said elastic surface waves in the extent of said refractive zone differing by a predetermined amount from that encountered in the neighboring regions of said surface; means for imparting a bending to the paths of travel followed by said elastic surface waves including a string of elementary tapered zones formed in said refractive zone; the mean paths of travel located midway between the limits of each said elementary zones being substantially equal from one of said elementary zones to the next for equalizing the attenuation undergone by said elastic surface waves upon being refracted by said refractive zone, the respective widths of said elementary zones measured along said string being greater than a multiple of the wavelength of said elastic surface waves upon which said bending is imparted.

2. A refractive stigmatic system as claimed in claim 1, wherein said elementary zones are delimited by two lines successively traversed by said elastic surface waves; said mean paths of travel being equal to the mean distance separating said lines from one another.

3. A refractive stigmatic system as claimed in claim 2, wherein at least one of said lines has a saw-tooth shape.

4. A refractive stigmatic system as claimed in claim 3, wherein said saw-tooth line has two opposite sets of tips; one of said sets of tips touching on the other of said lines.

5. A refractive stigmatic system as claimed in claim 1, wherein said tapered elementary zones are contiguous and tapered to form a convex Fresnel lens.

6. A refractive stigmatic system as claimed in claim 1, wherein said tapered elementary zones are contiguous and tapered to form a concave Fresnel lens.

7. A refractive stigmatic system as claimed in claim 1, wherein said tapered elementary zones are contiguous and tapered to form a deflecting prism.

8. A refractive stigmatic system as claimed in claim 1, wherein said refractive zone is a zone of the surface of said substrate carrying a layer of deposited material.

9. A refractive stigmatic system as claimed in claim 1, wherein said substrate being crystalline, said refractive zone is a zone located immediately below said surface in which numerous defects in the regular arrangement of atoms of the crystalline lattice have been created by ion implantation.

* * * * *